US006168145B1

(12) United States Patent
Tanaka et al.

(10) Patent No.: US 6,168,145 B1
(45) Date of Patent: Jan. 2, 2001

(54) APPARATUS AND METHOD FOR AUTOMATICALLY FINISHING COPIES AFTER THE MAXIMUM STORAGE TRAY CAPACITY HAS BEEN EXCEEDED

(75) Inventors: Hiroharu Tanaka; Yoichi Kawabuchi; Tomoyuki Atsumi, all of Toyohashi (JP)

(73) Assignee: Minolta Co., Ltd., Osaka (JP)

( * ) Notice: Under 35 U.S.C. 154(b), the term of this patent shall be extended for 0 days.

(21) Appl. No.: 09/086,941

(22) Filed: May 29, 1998

(30) Foreign Application Priority Data

May 30, 1997 (JP) ..... 9-142780

(51) Int. Cl.[7] ..... B65H 33/04

(52) U.S. Cl. ..... 270/58.11; 270/58.09; 414/789.9

(58) Field of Search ..... 270/58.11, 58.09; 414/789.9

(56) References Cited

U.S. PATENT DOCUMENTS

| | | | | |
|---|---|---|---|---|
| 4,445,680 | * | 5/1984 | Kikuchi et al. | 271/290 |
| 5,033,731 | * | 7/1991 | Looney | 271/176 |
| 5,137,266 | | 8/1992 | Mori et al. | 270/53 |
| 5,293,203 | * | 3/1994 | Wada et al. | 355/309 |
| 5,362,200 | * | 11/1994 | Ushirogata | 414/791 |
| 5,374,043 | * | 12/1994 | Mandel et al. | 270/53 |
| 5,435,544 | * | 7/1995 | Mandel | 271/298 |
| 5,461,469 | * | 10/1995 | Farrell et al. | 270/53 X |
| 5,464,201 | * | 11/1995 | Deen et al. | 270/53 |
| 5,509,645 | | 4/1996 | Shinno et al. | 270/58 |
| 5,580,045 | * | 12/1996 | Matsumoto et al. | 271/298 |
| 5,603,492 | * | 2/1997 | Mandel et al. | 270/58.09 |
| 5,609,333 | * | 3/1997 | Mandel et al. | 270/58.09 |
| 5,762,329 | * | 6/1998 | Nakazato et al. | 270/58.09 |
| 5,797,596 | * | 8/1998 | Morigami et al. | 270/58.11 |
| 5,876,027 | * | 3/1999 | Fukui et al. | 270/51 |
| 5,971,383 | * | 10/1999 | Horikawa et al. | 270/58.11 |

FOREIGN PATENT DOCUMENTS

| | | |
|---|---|---|
| 61-217464 | 9/1986 | (JP) . |
| 61-287656 | 12/1986 | (JP) . |

* cited by examiner

*Primary Examiner*—Christopher P. Ellis
*Assistant Examiner*—Richard Ridley
(74) *Attorney, Agent, or Firm*—Morrison & Foerster, LLP

(57) ABSTRACT

An apparatus and method for processing paper ejected from an image forming device includes the use of a plurality of bins for sorting the paper ejected from the image forming device into packets and for housing the packets. A tray for stacking the packets is provided, along with a packet conveying device for conveying the packets from the plurality of bins to the tray. A detection device is included for detecting the maximum amount of paper that can be stacked onto the tray. A control device is also included which performs a number of controlling functions such as halting the packet conveying device, counting the number of empty bins from which the packets have already been removed and transmitting the number to an image forming device controller, in addition to controlling the guidance of the paper subsequently ejected from the image forming device in the empty bins.

12 Claims, 9 Drawing Sheets

APPARATUS AND METHOD FOR AUTOMATICALLY FINISHING COPIES AFTER THE MAXIMUM STORAGE TRAY CAPACITY HAS BEEN EXCEEDED

FIELD OF THE INVENTION

The invention generally relates to an apparatus and method for processing paper, and more particularly, to a paper processing apparatus and method that can sort and staple sheets of paper ejected from a copying machine or printer, on which images have been formed.

DESCRIPTION OF RELATED ART

In recent years, various types of sorters for image forming devices such as copying machines and printers have been proposed. These sorters sort sheets of paper on which images have been formed into multiple bins in proper page sequence and staple them together when necessary.

In order to handle a large amount of paper, a sorter of this type must be constructed such that it contains a large-capacity tray separate from the multiple bins, wherein packets of sheets (hereinafter termed "packets") once sorted into the bins are transferred to the tray such that more sheets may be sorted into the emptied bins. A sorter of this type is conventionally known. See, for example, Japanese Published Patent Application No. 4-66786.

However, in a sorter of the type in which packets are sent from the bins to the high-capacity tray, if the tray reaches the limit of its capacity then Subsequent copy processing must be stopped. As a result, this reduces the productivity of the copy procedure. If copy processing were nonetheless to continue and subsequent sheets were to be sent to the sorter, then the sheets that could not be transferred to the tray and the sheets that were subsequently sent into the sorter would mix together, creating problems.

Thus, there reins an opportunity to improve the sorting and housing of paper in sorters. In particular, there exists a need for a paper processing apparatus and method that can perform continuous sorting for a number of packets exceeding the number of installed bins, and that can continue the image formation process even after the large-capacity tray to which the packets are transferred has reached the limit of its capacity.

SUMMARY OF THE INVENTION

The object of the invention is to provide a paper processing apparatus and method that, in paper sort mode, can perform continuous sorting for a number of packets exceeding the number of installed bins, and that can continue the image formation process even after the large-capacity tray to which the packets are transferred has reached the limit of its capacity.

In order to attain the above object, an apparatus and method for processing paper ejected from an image forming device are disclosed. The apparatus comprises a plurality of bins for sorting the paper ejected from the image forming device into packets, and for housing the packets, a tray for stacking the packets; packet conveying device for conveying the packets from the plurality of bins to the tray, detecting device for detecting the maximum amount of paper that can be stacked onto the tray; and control device for halting the packet conveying device when the detecting device detects the maximum amount of paper that can be stacked onto the tray, for counting the number of empty bins from which the packets have already been removed, for transmitting the counted number of empty bins to an image forming device controller, and for controlling the guiding the of paper subsequently ejected from the image forming device in the empty bins.

In the invention, where, for example, 30 packets are to be made but only 20 bins exist to handle them, initially the copy operations for the first 20 packets are performed, and one packet is sent to and housed in each bin. The packets are then removed from the bins and conveyed to and housed in the large-capacity tray by device of the packet conveying means. The subsequent copy operations for the remaining 10 packets are then performed. In this example, where it is detected by the detecting device that the tray has reached the limit of its capacity when the $17^{th}$ packet has been sent to the tray to be housed, the operation of the packet conveying device is stopped temporarily and the counted number of empty bins from which packets have been removed (in this case, 17) is sent to the image forming device controller. The image forming device then performs copying for the remaining 10 packets, and the paper ejected from the image forming device is distributed to and housed in the empty bins.

As is clear from the above explanation, since the number of empty bins is counted and the sheets that are subsequently sent to the sorter are housed in the empty bins, the image forming operation need not be completely prohibited even when the large-capacity tray has become full. Instead, the image forming operation can be continued in accordance with the number of empty bins, and this results in an improved copying efficiency. Moreover, the problem of sheets already housed in the bins becoming commingled with the sheets newly sent to the bins can be prevented.

The above features and advantages of the invention will be better understood from the following detailed description taken into conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

An embodiment of the paper processing apparatus pertaining to the invention will be explained below with reference to the accompanying drawings. In the embodiment explained below, the invention is applied in a stapler/sorter connected to an electrophotographic copying machine.

Figure 1:
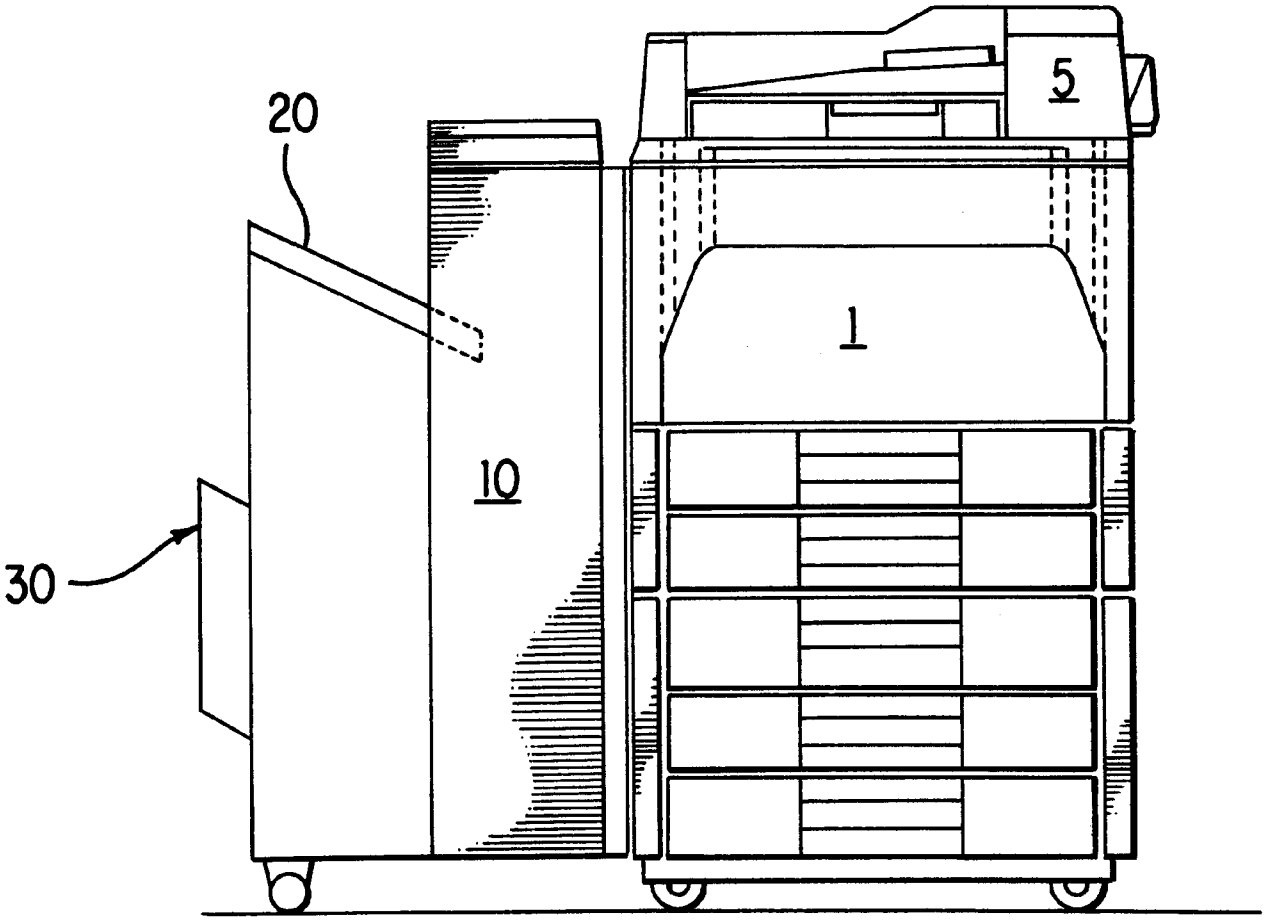
FIG. 1 is an elevational view of the external appearance of a stapler/sorter comprising an embodiment of the invention and a copying machine.

In FIG. 1, reference numeral 1 is an electrophotographic copying machine and reference numeral 10 is a stapler/sorter. Copying machine 1 forms images on paper using the public domain electrophotographic method, and is equipped with recycle-type automatic original document feeder 5 on top it. This automatic original document feeder 5 feeds the pages of a multi-page original document that sits in a tray to the platen glass in proper page sequence, ejects them from the platen glass when exposure of the number of copies designated by the operator has been performed, and then returns them to the tray.

Figure 2:
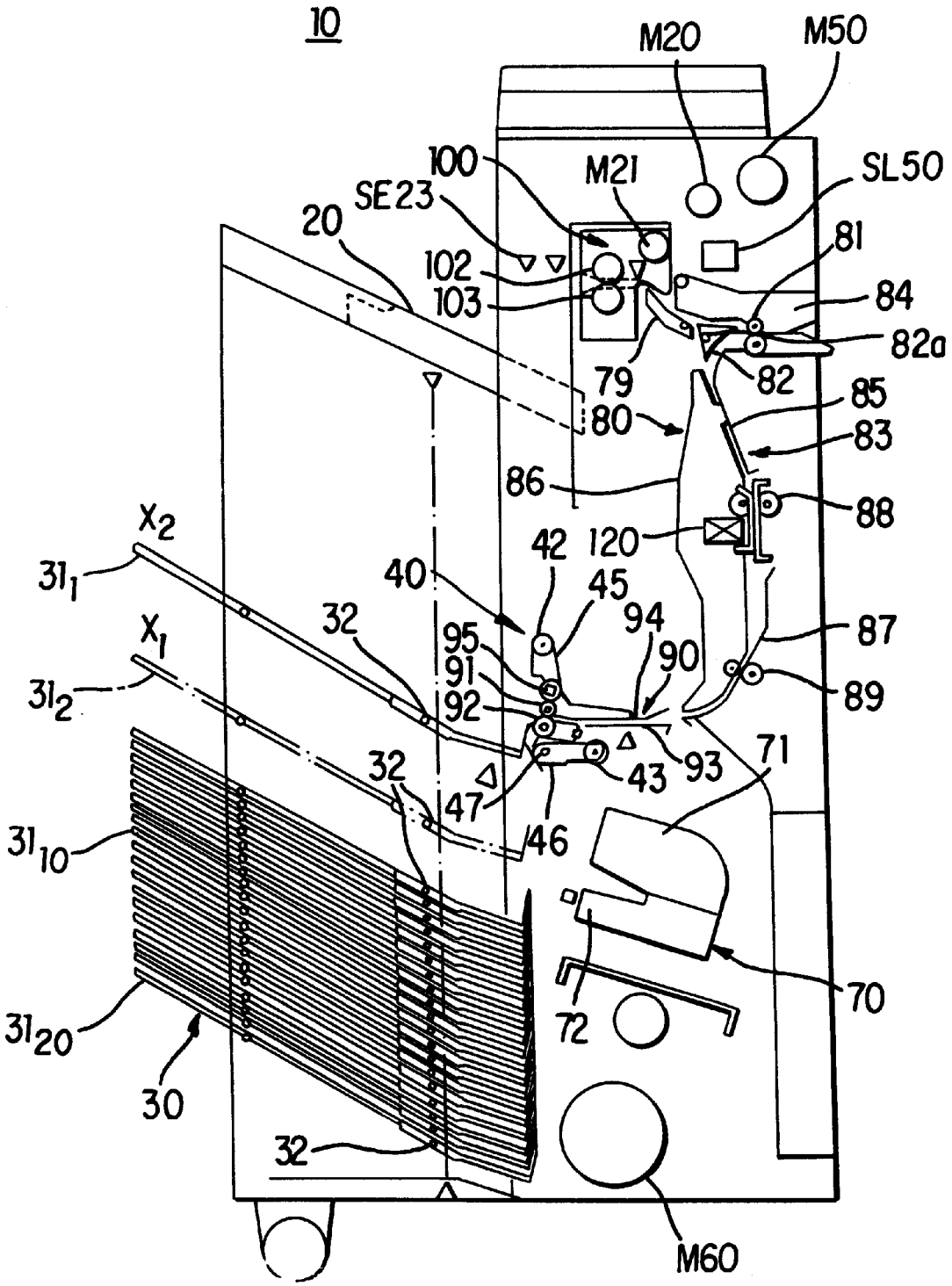
FIG. 2 is a drawing showing the basic construction of the stapler/sorter.

Referring to FIG. 2, the stapler/sorter 10 comprises essentially a large-capacity non-sort tray 20 a bin assembly 30 having 20 bins 31 (31$_1$ through 31$_{20}$), a removal unit 40 to remove the packets housed in the bins 31, a stapling unit 70, a paper conveying unit 80, a packet conveying gate 100, and a punch unit 120.

The stapler/sorter 10 can process sheets of paper on which images have been formed and that have been ejected from copying machine 1 in accordance with the various modes described below: (1) stacking of sheets in non-sort tray 20 without sorting them (non-sort mode), (2) sorting of sheets into bins 31 in proper page sequence (sort mode), (3) stapling of sorted packets (sort/staple mode), (4) removal of stapled packets housed in bins 31 and stacking the packets in non-sort tray 20 (sort/staple/stack mode), (5) removal of sorted packets from bins 31 and stacking them in non-sort tray 20 without stapling them (sort/stack mode), (6) distributing each page of a document to a different bin 31 (group mode), (7) stapling of grouped packets (group/staple mode), (8) removal of stapled packets from bins 31 and stacking them in non-sort tray 20 (group/staple/stack mode), and (9) removal of grouped packets from bins 31 and stacking them in non-sort tray 20 without stapling them (group/stack mode). Moreover, each of these modes can be combined with punch processing, in which punch holes are formed on a single sheet basis at a time while paper conveyance by paper conveying unit 80 is underway.

The internal construction of stapler/sorter 10 will now be explained in detail.

First, paper conveying unit 80 comprises a pair of receiving rollers 81 that receive sheets ejected from copying machine 1, a switching claw 82 that switches the direction of paper conveyance, a first conveying assembly 83 that extends essentially vertically, and a second conveying assembly 90 that extends essentially horizontally from the first conveying assembly 83 toward bin assembly 30. The switching claw 82 is mounted with pin 82*a* as a fulcrum such that it can rotate based on the switching ON and OFF of solenoid SL50. When the solenoid SL50 is in the OFF state, the switching claw 82 is set in the position indicated by the solid line in FIG. 2. When this condition is present, the sheet being received by the pair of receiving rollers 81 are guided by the curved, right-hand side surface of the switching claw 82 and sent to the first conveying assembly 83. When the solenoid SL50 is in the OFF state, the switching claw 82 revolves slightly in a clockwise direction. When this condition is present, the sheets are guided by the top surface of the switching claw 82 and guide plate 79 and conveyed onto the non-sort tray 20 via packet conveying gate 100. This is further explained below.

The first conveying assembly 83 comprises guide plates 84. 85, 86 and 87, as well as pairs of conveying rollers 88 and 89. The second conveying assembly 90 comprises conveying rollers 91 and 92, as well as guide plates 93 and 94, and can rotate approximately 90° upward with shaft 95 as a fulcrum. When the sort mode or group mode is active, the second conveying assembly 90 is set in the conveyance position indicated by the solid line in Fill. 2, and sends sheets conveyed from the first conveying assembly 83 to the bins 31 via the conveying rollers 91 and 92. When packet removal processing is performed as explained below, the second conveying assembly 90 rotates approximately 90° in a counter-clockwise direction with the shaft 95 as a fulcrum, rising, and retracting from the paper conveying position.

The pair of rollers 81, 88 and 89 and the rollers 91 and 92 are driven to rotate by motor M50.

The bin assembly 30 comprises 20 bins 31$_1$ through 31$_{20}$. Each bin 31 is oriented diagonally at a fixed distance from the adjacent bins, and engages with a spiral thread formed on the outer circumference of a drive shaft not shown in the drawings, on which pins 32 at the lower ends of the bins 31 are vertically mounted. By rotating this drive shaft forward or backward by means of motor M60, the bins 31 are raised or lowered by one pitch through one rotation of the drive shaft. The position indicated by the solid line in FIG. 2 is the lowermost position (home position) of the bin assembly 30. When it is in this position, the first bin 31$_1$ faces the conveying rollers 91 and 92. From here on, the position of bin 31 facing the conveying rollers 91 and 92 is termed level $X_2$. When the drive shaft rotates once backward, the first bin 31$_1$ descends to level $X_1$, and the packet is bound by staple unit 70 at this level $X_1$. When the drive shaft rotates once forward, the first bin 31$_1$ rises to level $X_2$, and the packet is removed at this level $X_2$. At this time, the subsequent bins 31$_2$ through 31$_{20}$ also rise one pitch, and the bin 31$_2$ is set at level $X_1$. When any bin 31 is set at levels $X_1$ or $X_2$, the spacing between itself and the adjacent bins 31 above and below is set more widely. The setting of the bin spacing is obtained by changing the pitch of the spiral thread of the drive shaft.

The removal unit 40 will now be explained.

The removal unit 40 grasps and removes a packet from the bin 31 set at level $X_2$, and comprises essentially an upper roller 42 supported by an upper arm 45, and a lower roller 43 supported by a lower arm 46. When the second conveying assembly 90 retracts upwards, the upper arm 45 rotates counter-clockwise using shaft 95 as a fulcrum, and the lower arm 46 rotates clockwise using shaft 47 as a fulcrum. As a result, the leading edge of the packet in the bin 31 is grasped and lifted by the rollers 42 and 43, and the packet is removed through the driven rotation of the rollers 42 and 43.

Next, the packet conveying gate 100 will be explained.

The packet conveying gate 100 is equipped with a pair of rollers 102 and 103, as shown in FIG. 2. The rollers 102 and 103 can rotate in a forward or backward direction by motor M21. This packet conveying gate 100 is guided by a guide in ember not shown in the drawings such that it may rise or descend, and the motor M20 operates as its drive source. The home position of the packet conveying gate 100 is the position indicated by the solid line in FIG. 2, and at this home position, the gate 100 conveys packets sent from the pair of receiving rollers 81 while being guided by the upper surface of the switching claw 82 to the left in FIG. 2 through the rotation of the rollers 102 and 103, and sends them to the non-sort tray 20.

Figure 3:
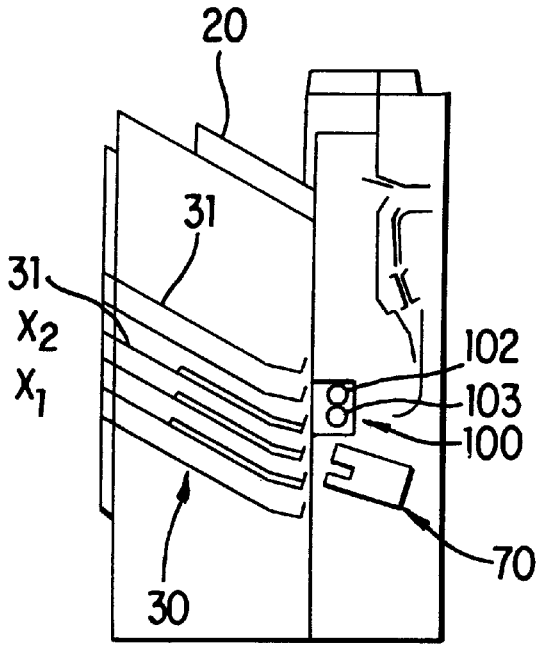
FIG. 3 is a drawing explaining the packet removal and stacking operations in the stapler/sorter.
Figure 4:
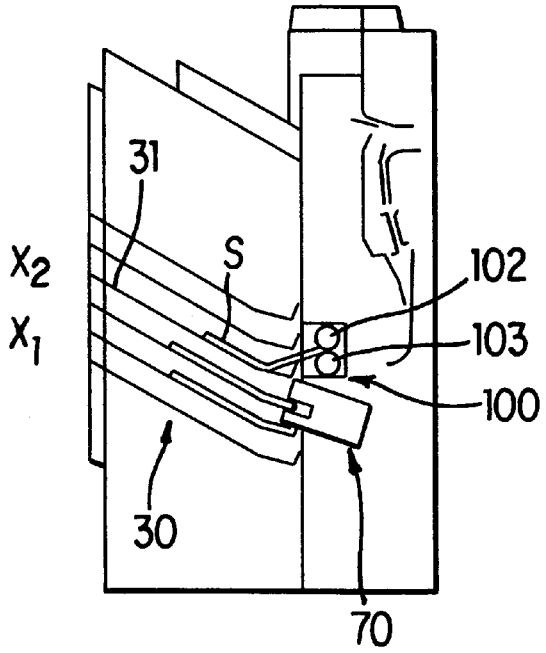
FIG. 4 is a drawing continuing the explanation of FIG. 3 of the packet removal and stacking operations in the stapler/sorter.
Figure 5:
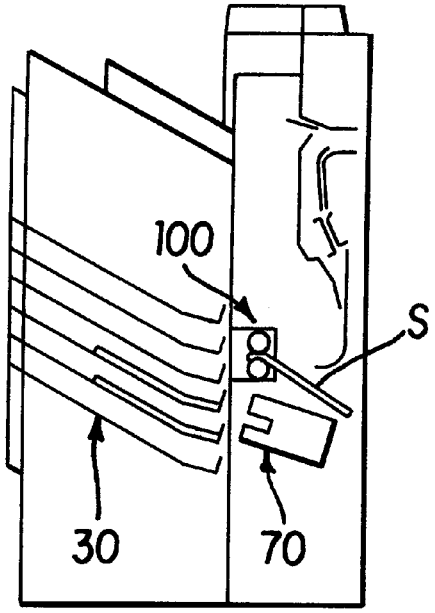
FIG. 5 is a drawing continuing the explanation of FIG. 4 of the packet removal and stacking operations in the stapler/sorter.
Figure 6:
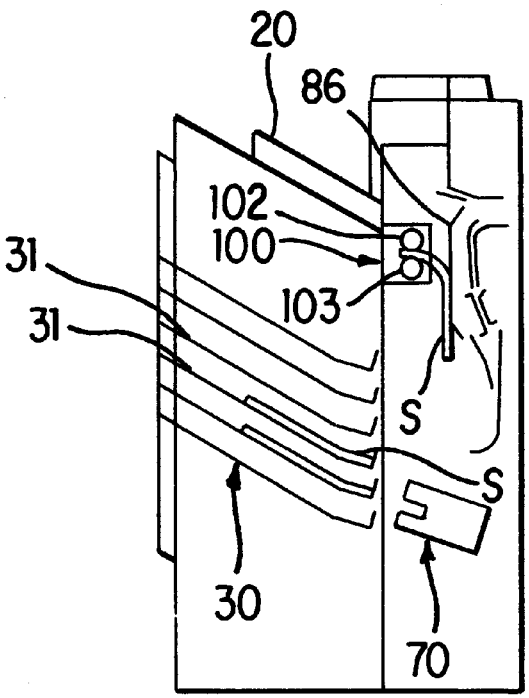
FIG. 6 is a drawing continuing the explanation of FIG. 5 of the packet removal and stacking operations in the stapler/sorter.
Figure 7:
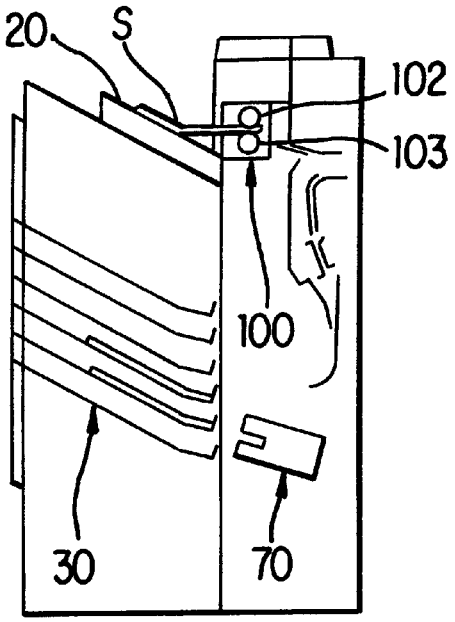
FIG. 7 is a drawing continuing the explanation of FIG. 6 of the packet removal and stacking operations in the stapler/sorter.
Figure 8:
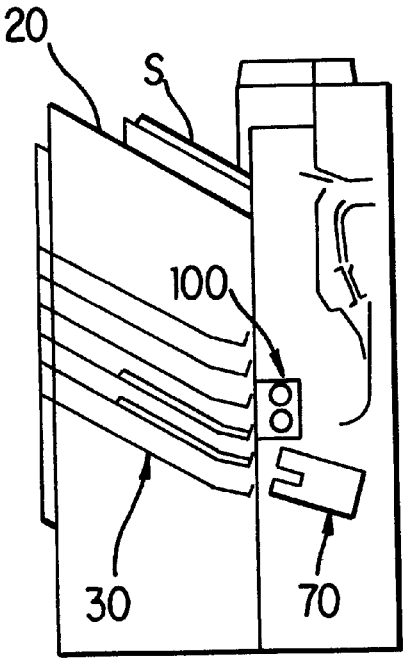
FIG. 8 is a drawing continuing the explanation of FIG. 7 of the packet removal and stacking operations in the stapler/sorter.

On the other hand, in order to receive stapled or non-stapled packets, the packet conveying gate 100 descends to the position facing the bin 31 set at level $X_2$ (see FIG. 3). At this removal position, the gate 100 grasps by means of rollers 102 and 103 packet S grasped and then removed from the bin 31 by the removal rollers 42 and 43 (see FIG. 4), and places packet S in the gate 100 based on the forward rotation of the rollers 102 and 103 (see FIG. 5). When the packet S is completely received by the gate 100, the forward rotation of the rollers 102 and 103 stops, and the gate 100 simultaneously rises (see FIG. 6). When the gate 100 rises to a prescribed height, the rollers 102 and 103 rotate backward, and the grasped packet S is ejected onto the non-sort tray 20 (see FIG. 7). The gate 100 then descends to the removal position (see FIG. 8), and the stacking operation is repeated.

The packet conveying gate 100 normally ejects non-sort sheets onto the tray 20 one sheet at a time at the position indicated in FIG. 2 (home position), and when the packets are stacked, the gate 100 begins ejecting packets onto the tray 20 from a position slightly lower than the home position. As the number of packets stacked on the tray 20 increases, the gate 100 rises above the home position and then stops, whereupon its packet is ejected onto the tray 20. The position at which the gate 100 rises and stops corresponds to a position at which a fixed distance is maintained between the packet ejection height from the rollers 102 and 103 and the top surface of the sheets stacked on the tray 20. In other words, the gate 100 rises to a position at which it can drop the next packet from a prescribed distance to the top surface of the paper on the tray at all times.

Incidentally, a sensor SE23 is provided for detecting the accumulation of sheets of paper on the non-sort tray 20 to its maximum capacity by detecting the top surface of the paper on tray 20. The sensor SE23 is located above the tray 20.

The stapling unit 70 will now be explained.

The stapling unit 70 consists of a public domain motor-powered mechanism, and comprises a head member 71 on which a cartridge that holds staples can be detachably mounted and an anvil member 72 that catches and bends staples that have been fired from the head member 71. This stapling unit 70 moves toward the bin 31 set at the level $X_1$, and drives staples into the packets at one corner location or two center locations (see FIG. 4). In other words, where the front side of the stapler/sorter 10 is deemed the home position, the stapling unit 70 moves toward the back side, stops at a prescribed position, moves toward the bin 31 drives in a staple, and finally returns to the home position.

Figure 9:
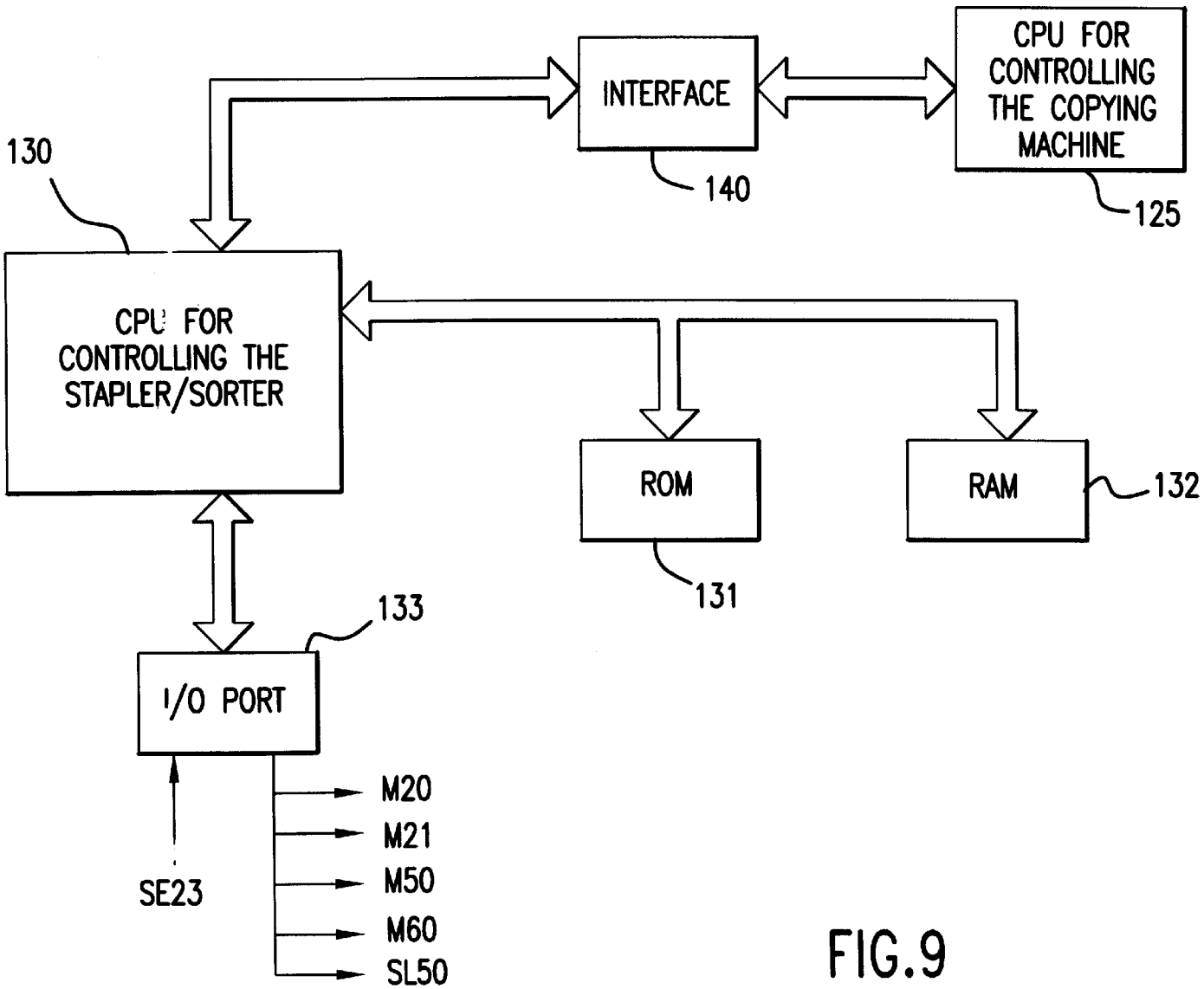
FIG. 9 is a block diagram showing the controller for the copying machine and the stapler/sorter.

FIG. 9 shows the controller for the copying machine 1 and the stapler/sorter 10. This controller mainly comprises a CPU 125 for controlling the copying machine 1, and a CPU 130 for controlling the stapler/sorter 10. The CPU 130 is equipped with a ROM 131 that houses a control program and a RAM 132 that houses the parameters for the execution of the control program, and is connected to the sensor SE23 and the motors M20 and M21 by I/O ports 133. The CPUs 125 and 130 exchange information by interface 140.

The sort mode operation of the stapler/sorter 10 having the construction described above will now be briefly explained.

The automatic original document feeder 5 can count how many times the original document has been recycled to the automatic original document feeder for copying, and in the sort mode, where the set number of copies exceeds 21, the original document is recycled for copying jobs comprising 20 copies each. For example, where the number of packets to be made is 50, first, 20 copies of each original document are made and distributed to bins $\mathbf{31}_1$ to $\mathbf{31}_{20}$ (first cycle). This is termed job one. After job one is completed, the packets in the bins 31 are sequentially stapled if necessary, and are then stacked on the non-sort tray 20 by the packet conveying gate 100. Another 20 copies are then made of the original document (second cycle), distributed to the bins $\mathbf{31}_1$ through $\mathbf{31}_{20}$, and stacked on the tray 20 as before. In the third cycle, the original document is copied 10 times, and the copies are distributed to the bins $\mathbf{31}_1$ through $\mathbf{31}_{10}$ and then stacked on the tray 20.

Incidentally, when the $37^{th}$ packet has been stacked on the tray 20, if it is detected by the sensor SE23 that the maximum capacity of the tray has been exceeded, then the gate 100 is held at the home position, and subsequent stacking operations are prohibited. The CPU 130 then counts the number of empty bins from which the packets were removed (in this case 17), and transmits the counted number of empty bins (17) to the CPU 125. The CPU 125 compares the transmitted number of empty bins and the number of packets remaining to be made, sets the number of packets to be made, which is less than the number of empty bins, and continues copying. In this example, because the number of empty bins is 17 and the number of remaining packets to be made is 10, copying for 10 packets is performed. The remaining 10 packets made are distributed to the empty bins 31. If the packets are removed from the non-sort tray 20 during this time, then the packets distributed to the bins 31 are stacked on the tray 20 by the gate 100.

The control process of the CPU 130 will now be explained with reference to the flow charts of FIGS. 10 through 12.

Figure 10:
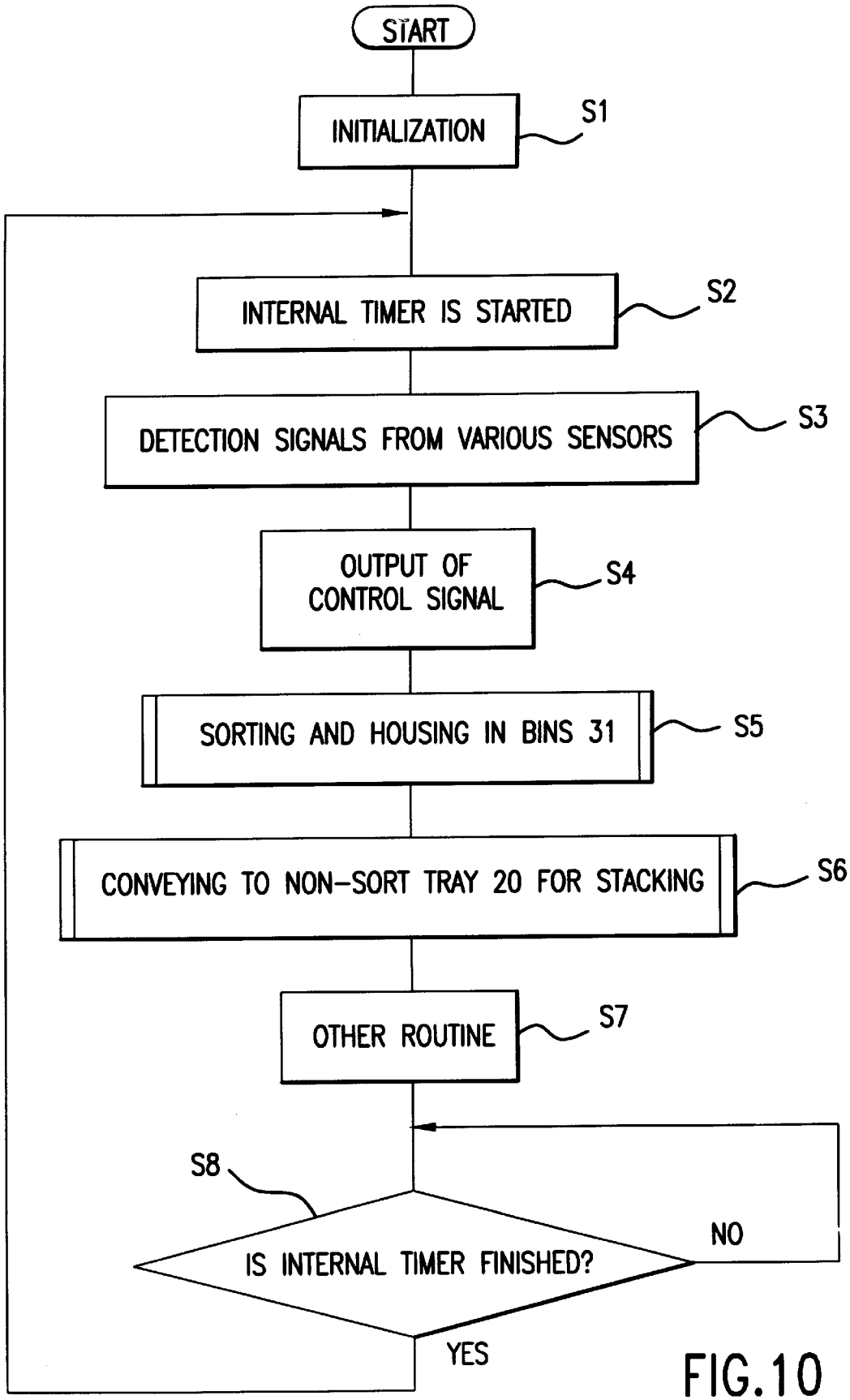
FIG. 10 is a flow chart showing the main routine of the control sequence of the CPU controlling the stapler/sorter.

FIG. 10 shows the main routine for the CPU 130.

When the power is turned ON and the program starts, first, in step S1, various control parameters and various devices are initialized. In step S2, the internal timer is started. Next, the subroutines of steps S3 through S7 are called in sequence and necessary processing is performed. Finally, when the ending of the internal timer is confirmed in step S8 the CPU 130 returns to step S2.

In step S3, detection signals from various sensors, etc., in the stapler/sorter 10 are read. In step S4, the control signals are output to various motors, etc. In step S5, the routine to sort sheets that are sent from the copying machine 1 to the stapler/sorter 10 and to house them in the bins 31 is performed. In step S6, the routine to convey the packets housed in each bin 31 to the non-sort tray 20 for stacking is performed. In step S7, other routines such as the detection of paper jam is performed.

Figure 11:
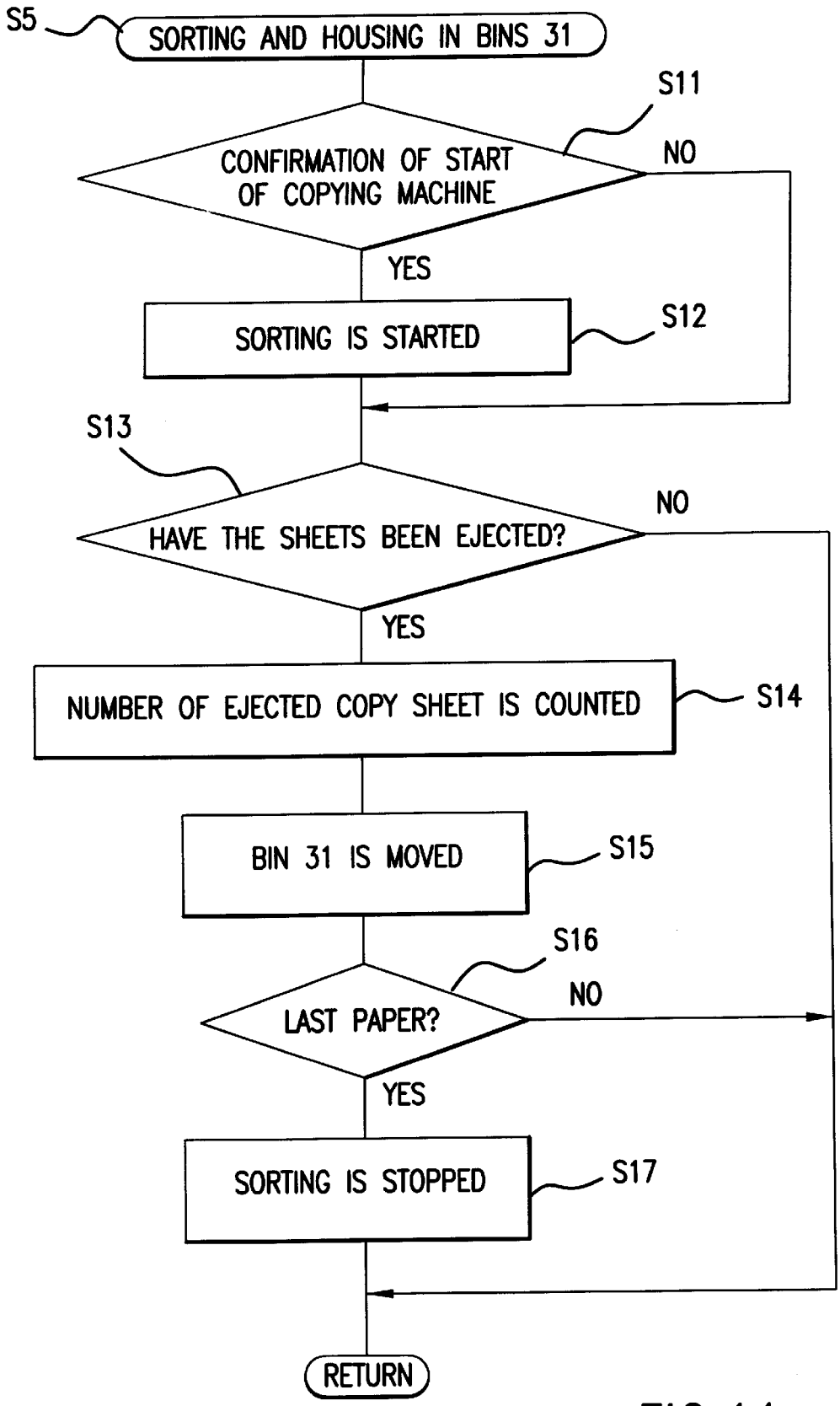
FIG. 11 is a flow chart showing the sorting subroutine.

FIG. 11 shows the subroutine for the sorting operation performed in the step S5.

First, when it is confirmed in step S11 that copying by copying machine 1 has begun, the routine to sort the copy sheets into the bins 31 is begun in step S12. Next, when it is confirmed in step S13 that the sheets have been ejected to the prescribed bins 31, the number of ejected copy sheets is counted in step S14 and the next bin 31 is moved to paper eject level $X_2$ in step S15.

Then in step S16, it is determined whether or not the last paper for job one has been ejected. If it has, sorting is stopped in step S17.

Figure 12:
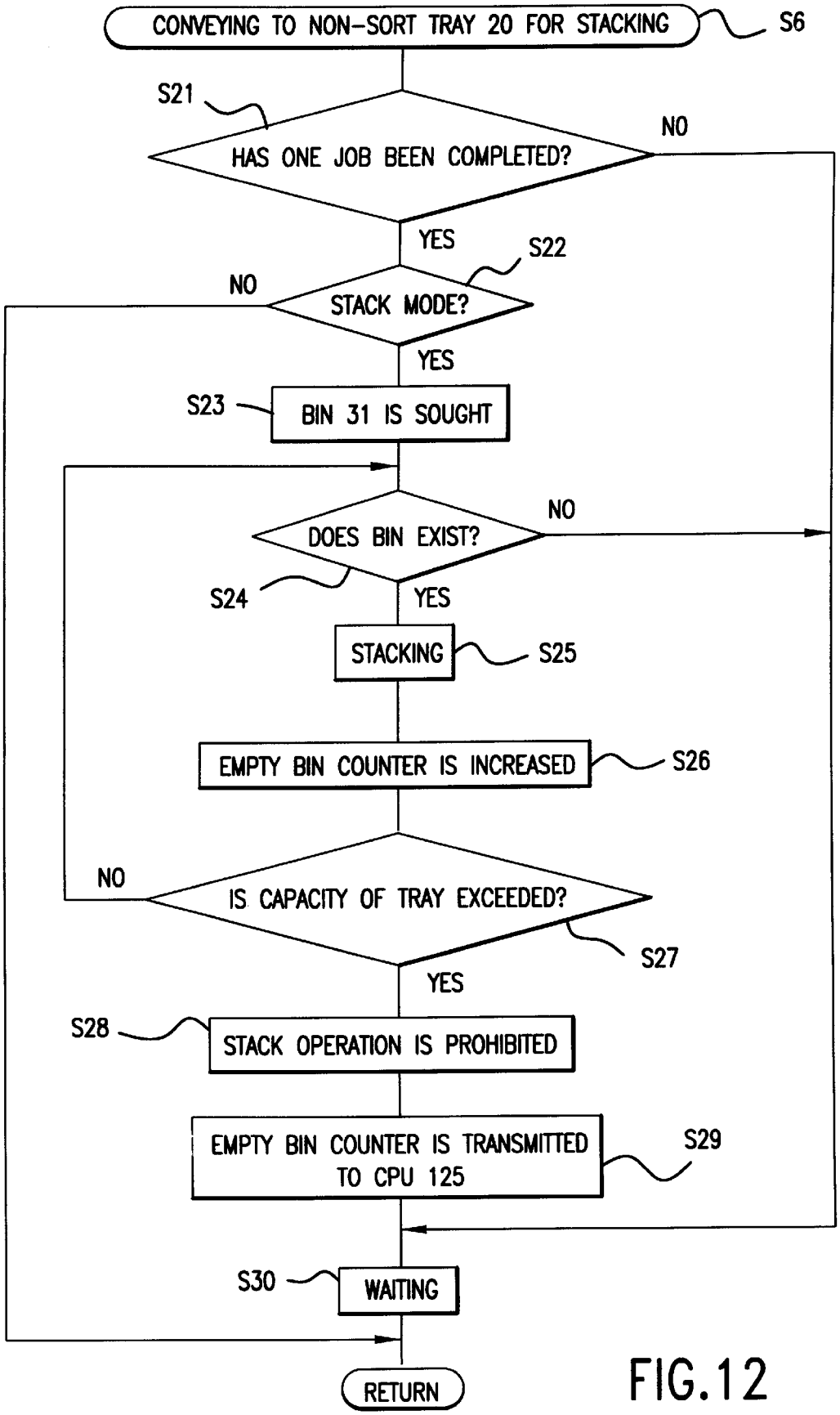
FIG. 12 is a flow chart showing the stacking subroutine.

FIG. 12 shows the subroutine for the stacking operation performed in step S6. First, it is determined in step S21 whether or not the job one has been completed. If the job one has not been completed (if copying is still underway), in step S30 the holding operation is performed i.e., the removal unit 40 or the gate 100 are held in a stand-by state. If the job one is completed, after confirmation in step S22 that the stack mode has been set, a bin 31 from which a packet is to be removed is sought in step S23. Where it is determined in step S24 that such a bin exists, the bin 31 is moved to the level $X_2$ in step S25 and stacking is performed. The number in the empty bin counter is then increased by 1 in step S26.

It is then determined in step S27 based on detection signals from the sensor SE23 whether or not the capacity of the non-sort tray 20 is being exceeded. If its capacity is not being exceeded, then the processes of steps S24 through S26 are repeated. If its capacity is being exceeded, then the stacking operation is prohibited in step S28, and the number in the empty bin counter is transmitted to copying machine control CPU 125 in step S29. The CPU 125 then sets the remaining number of copies to be performed based on the transmitted number of empty bins and continues the copying operation. When this occurs, the copy sheets ejected from the copying machine 1 are distributed to the empty bins 31.

The paper processing apparatus pertaining to the invention is not limited to the embodiment described above, and may be modified in various ways within its essential scope.

For example, the stapling unit 70 and the punch unit 120 are not essential to the invention.

Moreover, the invention may be applied in an apparatus other than the copying machine 1, such as a sorter connected to a printer that outputs image information transmitted from a host computer as hard copies.

While the invention has been described in detail with reference to a preferred embodiment and selected variations thereof it should be apparent to those skilled in the art that many modifications and variations are possible without departure from the scope and spirit of the invention as defined in the appended claims.

What is claimed is:

1. An apparatus for processing paper ejected from an image forming device, comprising:

a plurality of bins for sorting the paper ejected from the image forming device into packets, and for housing the packets;

a tray for stacking the packets;

packet conveying device for conveying the packets from the plurality of bins to the tray;

detecting device for detecting the maximum amount of paper that can be stacked onto the tray; and control device for halting the packet conveying device when the detecting device detects the maximum amount of paper that can be stacked onto the tray, for counting the number of empty bins from which the packets have already been removed, for transmitting the counted number of empty bins to an image forming device controller, and for controlling the guiding of the paper subsequently ejected from the image forming device in the empty bins.

2. The apparatus of claim 1, further comprising a stapling unit for stapling the paper.

3. The apparatus of claim 1 further comprising a punch unit for punching holes in the paper.

4. The apparatus of claim 1, wherein the image forming device is a digital copier.

5. The apparatus of claim 1, wherein the image forming device is an analog copier.

6. The apparatus of claim 1, wherein the image forming device is a computer printer.

7. The apparatus of claim 1, further comprising means for detecting paper jam.

8. The apparatus of claim 1, wherein the image forming device controller sets the number of packets to be made by comparing the counted number of empty bins and the number of packets remaining to be made.

9. The apparatus of claim 4, wherein the digital copier comprises memory for storing data representing the image being formed.

10. A method for processing paper ejected from an image forming device, comprising:

sorting and housing the paper ejected from the image forming device into packets in a plurality of bins;

conveying the packets from the plurality of bins to a stacking tray;

detecting the maximum amount of paper that can be stacked on the stacking tray;

halting the conveying when the maximum amount of paper that can be stacked on the stacking tray is detected;

counting the number of empty bins from which the packets have already been removed; and housing the paper subsequently ejected from the image forming device in the empty bins from which the packets have already been removed.

11. The method of claim 10, further comprising transmitting the counted number of empty bins to an image forming device controller after the counting of the number of empty bins.

12. The method of claim 10, further comprising detecting paper jam.

* * * * *